US006244585B1

(12) United States Patent
Yoshiura et al.

(10) Patent No.: US 6,244,585 B1
(45) Date of Patent: Jun. 12, 2001

(54) SHEET PROCESSING APPARATUS WITH SWITCHING AMONG PLURAL TYPES OF PAPER

(75) Inventors: Syoichiro Yoshiura, Tenri; Tatsuo Nomura, Kyoto, both of (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 09/361,844

(22) Filed: Jul. 27, 1999

(30) Foreign Application Priority Data

Aug. 7, 1998 (JP) ..... 10-224158

(51) Int. Cl.[7] ..... B65H 3/44; B65H 5/26

(52) U.S. Cl. ..... 271/9.01; 271/9.05; 271/9.06; 399/369; 399/16; 399/367

(58) Field of Search ..... 271/9.01, 9.05, 271/9.06; 399/369, 16, 367

(56) References Cited

U.S. PATENT DOCUMENTS 4,693,459 9/1987 Shimoda et al. .
5,271,614 * 12/1993 Yamada et al. ..... 271/9.06
5,523,822 * 6/1996 Tsuda ..... 399/13

FOREIGN PATENT DOCUMENTS 62-40257 8/1987 (JP) .

* cited by examiner

*Primary Examiner*—Donald P. Walsh
*Assistant Examiner*—Johnathan R. Miller
(74) *Attorney, Agent, or Firm*—Renner, Otto, Boisselle & Sklar

(57) ABSTRACT

Every time the paper size setting key is operated, the count value in the counter is increased by one. It is judged whether the count value in the counter after increment is greater than the maximum value Cm. If the count value of the counter is greater than the maximum value Cm, the count value is set at '1'. Then the CPU highlights the feeder position corresponding to the count value of the counter, among several feeder positions in the paper size setting frame. If new paper is loaded during the waiting period for the operation of the paper size setting key, the CPU detects count value Cs corresponding to the feeder position to which new paper has been loaded and sets the counter at a count value of Cs−1.

8 Claims, 11 Drawing Sheets

SHEET PROCESSING APPARATUS WITH SWITCHING AMONG PLURAL TYPES OF PAPER

BACKGROUND OF THE INVENTION (1) Field of the Invention

The present invention relates to a sheet processing apparatus which selectively feeds one type of paper from multiple types of paper stored in a paper feeding portion to a processing portion where a predetermined process is implemented.

(2) Description of the Prior Art

In a sheet processing apparatus such as an image forming apparatus which feeds a sheet of paper from a paper feeding portion to a processing portion and performs a predetermined process for the fed paper, it is necessary to feed the paper of a size which corresponds to the process therefor. For example, in a copier for duplicating the image of an original onto a sheet of paper, it is necessary to feed the paper, which corresponds to the image size of the original and the copy magnification, to the processing portion. Various types of paper, different in material and thickness are fed in correspondence with the use of the sheets after processing. For example, when a cover page is duplicated in a copier, a different type of sheet, dissimilar in material and thickness from those used for duplication of the content images may be used.

In this way, among sheet processing apparatus to which different types of sheets may be fed from the paper feeding portion to the processor, there are models in which plural types of paper are accommodated beforehand in the paper feeding portion in order to allow for easy change of the paper to be fed, and one type of paper to be fed to the processing portion can be selected from plural types of paper accommodated in the paper feeding portion by operating the control means such as paper selection keys etc., in accordance with the processing conditions. In such a sheet processing apparatus, every time the control means is operated, the type of paper to be fed to the processing portion is switched and selected from the plural types of paper accommodated in the paper feeding portion, in the predetermined sequential order.

However, in a case of a sheet processing apparatus which can accommodate many types of paper in the paper feeding portion, the operator may have to operate the control means repeatedly many times before the operator's desired selection of paper as the type of paper to be fed to the processing portion, needing time-consuming complicated procedures for selecting the type of paper to be fed to the processing portion, resulting in degradation of operating efficiency of the sheet processing apparatus.

Japanese Patent Publication Sho 62 No. 40257 discloses a configuration in which when new paper is loaded, the type of paper newly loaded will be selected and fed to the processing portion regardless of the operated state of the control means. Thus, this disclosure demonstrated that, when the operator has loaded the desired type of paper to be used into the paper feeding portion, the newly loaded paper will be automatically selected and fed to the processing portion without any operation via the control means, thus making it possible to simplify the selecting task of the type of paper to be fed to the processing portion. This disclosure also mentioned that it is possible to prevent waste of paper due to erroneous paper feed when the operator forgot to operate the control means after the paper has been loaded in the paper feeding portion.

However, in the configuration disclosed in Japanese Patent Publication Sho 62 No. 40257, when new paper has been loaded, the operator cannot select the paper to be fed to the processing portion through the operation of the control means. That is, it becomes impossible to reflect the operator's intention for the choice of the paper to be fed to the processing portion. Therefore, when a type of paper which is not the one to be fed to the processing portion is newly loaded to the paper feeding portion, for example, as in the case where an operator notices that, among the plural types of paper, a type of paper which should be stored in the paper feeding portion but is not the desired one to be fed to the processing portion is used up and supplies the paper, or as in the case where another operator other than the operator who is going to select the paper type supplies the paper to the paper feeding portion, paper which is not desired by the latter operator will be fed to the processing portion, thus giving rise to a failure to feed correct paper.

SUMMARY OF THE INVENTION

It is therefore an object of the present invention to provide a sheet processing apparatus which, when new paper was loaded to the paper feeding portion, sets up the newly loaded paper as the one to be fed to the processing portion waiting for the operator's operation through the control means so as to perform the selecting task of the paper to be fed to the processing portion in a correct and efficient manner.

In order to achieve the above object, the present invention is configured as follows:

In accordance with the first aspect of the present invention, a sheet processing apparatus which selects and feeds one type of paper from plural types of paper accommodated in paper feeding portion to a processing portion to execute a predetermined process for the paper, is characterized in that paper to be fed to the processing portion is selected from the plural types of paper stored in the paper feeding portion by switching from one to another in a predetermined sequential order from the paper which was loaded to the paper feeding portion last.

In accordance with the second aspect of the present invention, the sheet processing apparatus having the above first feature, further includes a time measuring means for measuring the time which has elapsed from the last time when paper was loaded to the paper feeding portion, and is characterized in that, during the period before time measured by the time measuring means reaches the predetermined time, paper to be fed to the processing portion is selected from the plural types of paper stored in the paper feeding portion by switching from one to another in a predetermined sequential order from the paper which was loaded to the paper feeding portion last.

In accordance with the third aspect of the present invention, the sheet processing apparatus having the above first feature further includes a control means that allows for designation of the paper to be fed from the paper feeding portion to the processing portion, and is characterized in that every time the control means is operated, paper to be fed to the processing portion is selected from the plural types of paper by switching the feeder position from one to another in a predetermined sequential order from that to which paper was loaded last.

In accordance with the fourth aspect of the present invention, the sheet processing apparatus having the above second feature further includes a control means that allows for designation of the paper to be fed from the paper feeding portion to the processing portion, and is characterized in that every time the control means is operated, paper to be fed to the processing portion is selected from the plural types of paper by switching the feeder position from one to another in a predetermined sequential order from that to which paper was loaded last.

In accordance with the fifth aspect of the present invention, the sheet processing apparatus having the above first feature is characterized in that the processing portion is an image forming processing portion for forming images on the paper fed from the paper feeding portion.

In accordance with the sixth aspect of the present invention, the sheet processing apparatus having the above second feature is characterized in that the processing portion is an image forming processing portion for forming images on the paper fed from the paper feeding portion.

In accordance with the seventh aspect of the present invention, the sheet processing apparatus having the above third feature is characterized in that the processing portion is an image forming processing portion for forming images on the paper fed from the paper feeding portion.

In accordance with the eighth aspect of the present invention, the sheet processing apparatus having the above fourth feature is characterized in that the processing portion is an image forming processing portion for forming images on the paper fed from the paper feeding portion.

According to the first feature of the invention, when new paper has been loaded to the paper feeding portion before the selection of paper to be fed, paper to be fed is selected in a predetermined sequential order from the paper newly loaded. Therefore, paper to be fed to the processing portion can be selected quickly during the paper selecting task after the paper to be fed has been loaded to the paper feeding portion. Further, during the paper selecting task after paper which is different from that to be fed was loaded to the paper feeding portion, paper to be fed to the processing portion is selected in a predetermined sequential order.

According to the second feature of the invention, when new paper has been loaded to the paper feeding portion before the selection of paper to be fed, during the period from the time at which new paper was loaded until the predetermined time elapses, paper to be fed is selected in a predetermined sequential order from the paper newly loaded. Therefore, paper to be fed to the processing portion can be selected quickly during the paper selecting task after the paper to be fed has been loaded to the paper feeding portion until the predetermined time elapses. Further, during the paper selecting task after the predetermined time has elapsed from loading of paper to the paper feeding portion or after paper which is different from that to be fed has been loaded to the paper feeding portion, paper to be fed to the processing portion is selected in a predetermined sequential order.

According to the third and fourth features of the invention, when new paper has been loaded to the paper feeding portion before the selection of paper to be fed, every time the control means is operated, paper to be fed is switched one from another in a predetermined sequential order from that to which new paper was loaded. Therefore this configuration permits quick selection of paper, enabling the first operation of the control means to select the paper newly loaded as the paper to be fed to the processing portion, during the paper selecting task after the paper to be fed has been loaded to the paper feeding portion. Further, during the paper selecting task after paper which is different from that to be fed has been loaded to the paper feeding portion, paper to be fed to the processing portion is selected by operating the control means the predetermined number of times.

According to the fifth through eighth features of the invention, when new paper has been loaded to the paper feeding portion before the selection of paper to be fed to the image forming portion, paper to be fed is selected in a predetermined sequential order from the paper newly loaded. Therefore, paper to be fed to the image forming portion can be selected quickly during the paper selecting task after the paper to be fed has been loaded to the paper feeding portion. Further, during the paper selecting task after paper which is different from that to be fed has been loaded to the paper feeding portion, paper to be fed to the image forming portion is selected in a predetermined sequential order.

DESCRIPTION OF THE PREFERRED EMBODIMENTS

Figure 1:
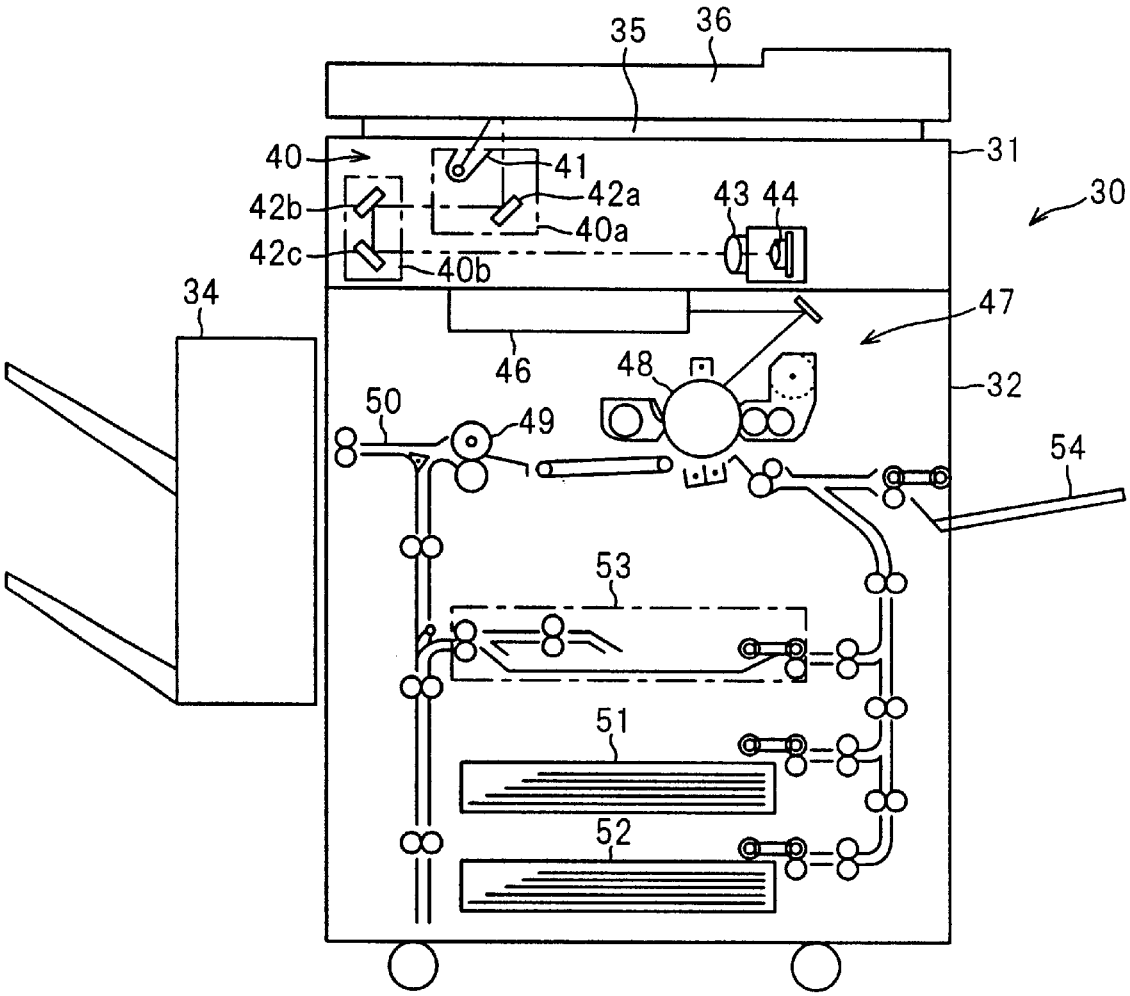
FIG. 1 is a view showing the configuration of a digital copier as the sheet processing apparatus in accordance with the embodiment of the invention.

FIG. 1 is a view showing the configuration of a digital copier as a sheet processing apparatus in accordance with an embodiment of the invention. A digital copier 30 according to the embodiment of this invention performs image forming process in different modes including a copy mode for original images, a printer mode for image data produced by an external apparatus such as a personal computer etc. and a facsimile mode for facsimile image transmitted via the public phone network.

Digital copier 30 is mainly composed of a scanner portion 31 and laser recording portion 32. Scanner portion 31 includes: an original table 35 of transparent glass; a reversing automatic document feeder (to be referred to as RADF, hereinbelow) 36 for delivering originals onto the upper surface of original table 35; and a scanner unit 40 for capturing the image of an original placed on the upper surface of original table 35. The image data of an original read by scanner portion 31 is output to laser recording portion 32.

RADF 36 includes: a one-sided original feed path from an unillustrated original tray to an unillustrated original output tray via original table 35; a two-sided original feed path for inverting the document, of which the image on a first side has been read by scanner unit 40, upside down and leading it again to original table 35; a feed path switching means for selecting either the one-sided original feed path or two-sided original feed path in accordance with the operator's choice; conveyance rollers and a conveyance belt for giving a force of conveyance to the original in the feed paths; and sensors for detecting the conveyed state of the original in the feed path.

Scanner unit 40 includes a lamp reflector assembly 41, mirrors 42*a* to 42*c*, a lens 43 and a photoelectric transducer 44. Lamp reflector assembly 41 is provided with mirror 42*a* in a first mirror base 40*a* while mirrors 42*b* and 42*c* are provided in a second mirror base 40*b*. First mirror base 40*a* moves at a predetermined speed along the underside of original table 35 so as to scan the whole surface of the image of the original placed on original table 35, by illuminating it with light from lamp reflector assembly 41. Second mirror base 40*b* moves along the undersurface of original table 35 at half the speed of first mirror base 40*a* so as to guide the reflected light from the original image surface to lens 43 with its optical path length unvaried. Lens 43 focuses the reflected light from the image face of the original on the photoreceptor surface of photoelectric transducer 44. Photoelectric transducer 44 converts the reflected light from the original image surface into an electric signal, which is output to an image processor described later.

Laser recording portion 32 includes a paper conveyance portion 50 for conveying paper, a laser writing unit 46 and an electrophotographic processing unit (image processing unit) 47. Paper conveyance portion 50 comprises: feed rollers, conveyance rollers, a conveyance belt and discharge rollers which define a paper feed path from a manual feeder tray 54 and paper cassettes 51 and 52 by way of electrophotographic processing unit 47 to a post processing unit 34 arranged on the side of the sheet discharge port of copier 30.

Paper conveyance portion 50 further includes an auxiliary conveyance path for re-feeding the paper having once passed through fixing rollers 49 inverting it upside down or without inverting it to electrophotographic processing unit 47 by way of an intermediate tray 53, in a duplex copy mode for forming images on both sides of the paper or in a multi-copy mode for forming multiple images of originals on one side of paper. Manual feeder tray 54 and paper feed cassettes 51 and 52 included in the paper feeding portion of the invention each have a sensor for detecting the loading of paper.

Laser writing unit 46 includes: a semiconductor laser for emitting a laser beam based on the image data supplied from the image processor; a polygon mirror for deflecting the light emitted from the semiconductor laser in the main scan direction onto the surface of a photoreceptor drum 48 of electrophotographic processing unit 47; and an f-θ lens for constant linear velocity deflection of the laser beam. By this configuration, laser writing unit 46 reproduces and illuminates an image of light based on the image data, which was produced by image processing in the image processor, on the surface of photoreceptor drum 48.

Electrophotographic processing unit 47 is configured of rotatably supported, photoreceptor drum 48 and a primary charger, a developing unit, a transfer charger, a separation charger, a cleaner, an erasing device and the like, arranged around the photoreceptor drum. The surface of photoreceptor drum 48 is uniformly charged with a single polarity by the primary charger in preparation for exposure of the image of light by laser writing unit 46. When an image of light is radiated, a static latent image forms by the photoconductive effect. Then, this static latent image is supplied with toner from the developing unit, so that it is developed into a toner image.

Paper conveyance portion 50 feeds a sheet of paper into the gap between photoreceptor drum 48 and the transfer charger in time with the rotation of photoreceptor drum 48, where the toner image supported on the surface of photoreceptor drum 48 transfers to the sheet by the action of corona discharge from the transfer charger. The sheet with the toner image transferred thereon is separated from photoreceptor drum 48 by the action of corona discharge from the separation charger and then guided into fixing rollers 49, where the sheet is heated and pressed so that the toner image is fused and fixed to the sheet surface. The surface of photoreceptor drum 48 after the transfer of the toner image to the sheet is removed of the residual toner by the cleaner and then residual charge is also removed by erasing device. Thereafter, the photoreceptor surface is again supplied with charge from the primary charger, then followed by the next electrophotographic process.

Figure 2:
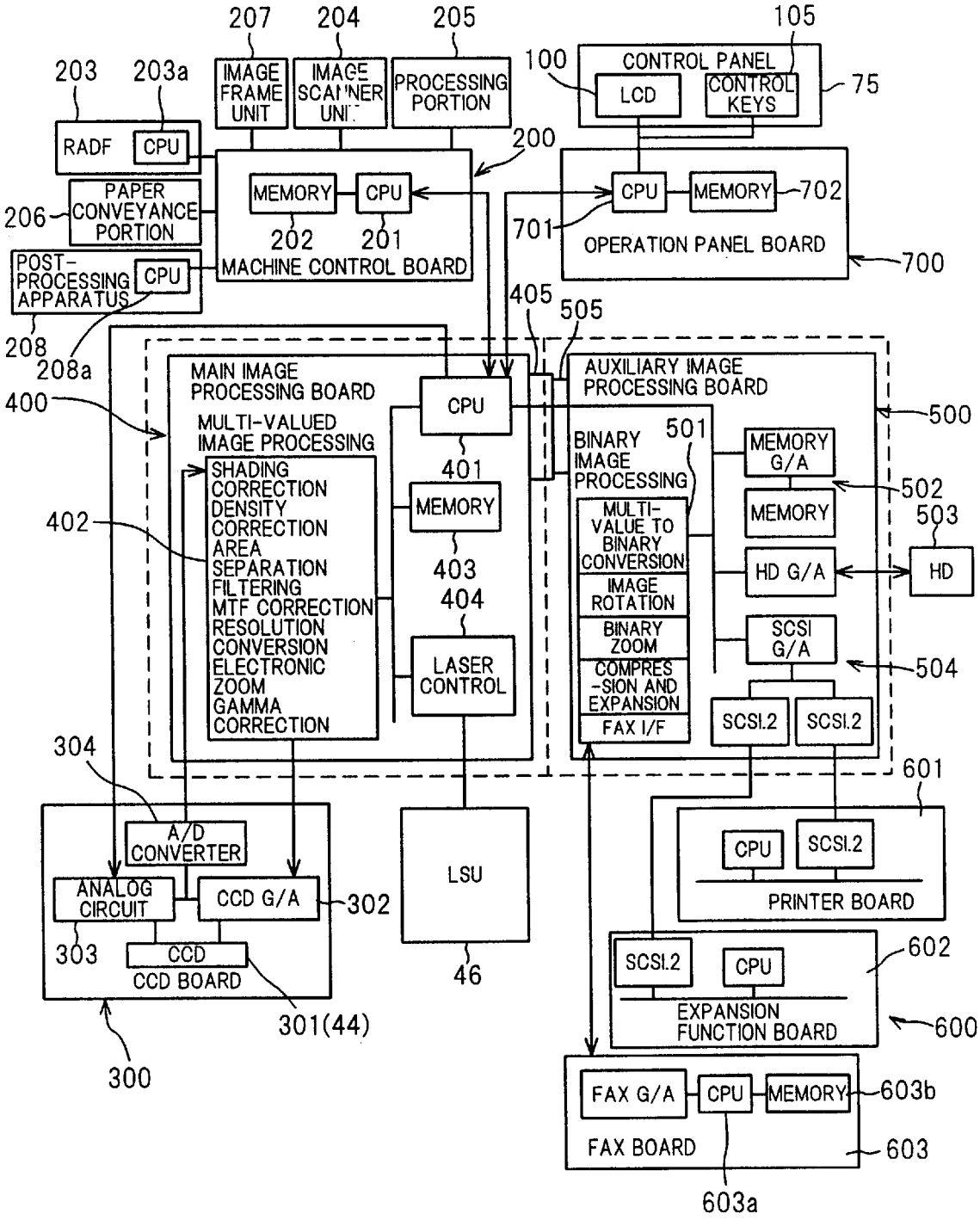
FIG. 2 is a block diagram showing the configuration of a controller of the copier.

FIG. 2 is a block diagram showing the configuration of the controller of the copier. The controller of copier 30 has a CPU 401 on a main image processing board 400 and this CPU integrally controls various device units each having a CPU. Illustratively, the controller of copier 30 includes: an operation panel board 100 for managing the control panel provided on the top of copier 30; a machine control board 200 for managing various units of copier 30; a CCD board 300 having photoelectric transducer 44 provided thereon with its peripheral parts; a main image processing board 400 having a CPU 41 for performing various basic image processes on the image data with its peripheral parts; an auxiliary image processing board 500 for optionally performing various image processes on the image data after the image processing in main image processing board 400; a group of expansion boards 600 including a printer board 601, an expansion function board 602, a facsimile board 603 corresponding to the expansion functions of copier 30 such as printer function, facsimile function and the like.

An operation panel board 700 has a slave CPU 701 with a memory 702, which is slaved by CPU 401 of main image processing board 400 as the master CPU. CPU 701 controls the display data to be given to a liquid crystal display (LCD) 100 arranged on a control panel 75 and the control data of control keys 105 including touch panel and temporarily stores the data to be input into and output from CPU 701, into memory 702. The configuration of control panel 75 will be described later. CPU 701 performs data exchange with CPU 401, that is, sends the data of the contents of operation instructions given by the operator through control keys 105, to CPU 401 and displays the operation state of copier 30 on a display device 6 based on the data transmitted from CPU 401.

Machine control board 200 has a slave CPU 201 with a memory 202, which is slaved by CPU 401 of main image processing board 400 as the master CPU. CPU 201 controls post-processing unit 34, RADF 36, scanner portion 31, electrophotographic process unit 47 and paper conveyance portion 50.

CCD board 300 includes photoelectric transducer 44, a gate array 302 for driving photoelectric transducer 44, an analog circuit 303 for performing gain control, etc., of the output signal from photoelectric transducer 44, and an A/D converting circuit 304 for converting the output signal from analog circuit 303 into digital data. These photoelectric transducer 44 and circuits 302 to 304 are controlled by CPU 401 provided on main image processing board 400.

Main image processing board 400 has CPU 401, multi-valued image processing section 402, a memory 403, a laser controller 404. Multi-valued image processing section 402 subjects the image data input through A/D converting circuit 304 of CCD board 300, to shading correction for reproducing desired tones of image, density correction, image area separation, filtering, MTF correction, resolution conversion, magnification/reduction process, gamma correction and other image processings for multi-valued image data. Memory 403 stores the image data after image processing, together with the control data for management of the image processing procedures. Laser controller 404 drives the semiconductor laser in laser writing unit 46 in accordance with the image data after image processing.

Auxiliary image processing board 500 is connected to main image processing board 400 by way of connectors 405 and 505, and has binary image processing section 501 and memory 502 and hard disc 503, SCSI 504 which are controlled by CPU 401 provided on main image processing board 400. Binary image processing section 501 has a conversion and processing section for converting the multi-valued image data into binary image data, a rotating section for rotating images, variable magnification processing section for varying the magnification of the binary image data and other processors, and further includes a facsimile interface for transmission and reception of facsimile images. The input and output of the data for memory 502, hard disc 503 and SCSI 504 are carried out via a gate array.

Expansion board 600 has printer board 601 for reception of the image data input from external apparatuses such as a personal computer and the like, expansion function board 602 for allowing the image data edited by the editing functions of copier 30 to be used in an external apparatus, facsimile board 603 for transmission and reception of image data by way of public phone networks, and the like.

Now, image data processings in the copy mode, printer mode and facsimile mode in copier 30 will be described.

In the normal copy mode, the image of an original fed by RADF 36 onto original table 35 is sequentially scanned by scanner unit 40 and transferred as 8 bit image data to main image processing board 400, wherein the data is subjected to the predetermined image processes in multi-valued image processing section 402. Then the processed data is supplied to laser writing unit 46 via laser controller 404. Thus, a tonal copy image is formed on the recording paper in recording portion 32 so that it is output.

In an electronic RDH functional copy mode, the image of an original fed by RADF 36 onto original table 35 is sequentially scanned by scanner unit 40 and transferred as 8 bit image data to main image processing board 400, wherein the data is subjected to the predetermined image processes in multi-valued image processing section 402. Then the processed data is supplied to auxiliary image processing board 500. In auxiliary image processing board 500, the image data of 8 bits is subjected to binary processes, inclusive of error diffusion etc., in binary image processing section 501 so that the data is stored as one-bit image data for each original, into hard disc 503. These procedures are performed for all the originals set in RADF 36. Multiple images of data stored in hard disc 503 are repeatedly read out the number of times which they are designated to be copied, in sequential page order under control of the gate array. Then the data is subjected to the predetermined image processes in main image processing board 400 and thereafter, the processed data is supplied to laser writing unit 46 by way of laser controller 404.

Accordingly, when a multiple number of copies are image formed from each original, only one scan of each original image needs to be performed. In this electric RDH functional copy mode, since the image data is binarized when the images of all the originals set in RADF 36 are once stored in hard disc 503, hard disc 503 does not need a large quantity of memory capacity. Further, since error diffusion or other processes are implemented during the binarizing process, the image quality will not degrade very much. Here, the binarized image data may be output to main image processing board 400 so that the image forming process for the first copy can be performed in parallel with the data writing into hard disc 503.

In the printer mode, the image data input from an external apparatus such as a personal computer etc., is expanded in printer board 601 as pagewise images, then the data is temporarily supplied to auxiliary image processing board 500, via SCSI 504 and stored into hard disc 503. During this, no binarizing process is performed in auxiliary image processing board 500. The image data stored in hard disc 503 is read out to be collated appropriately and output to main image processing board 400, where the data is subjected to gamma correction and the like and then supplied to laser writing unit 46 via laser controller 404.

The processing in the facsimile mode includes transmission of image data and reception of image data. In order to transmit the image data of originals, transmission originals set in RADF 36 are fed sheet by sheet to original table 35 and read out by scanner unit 40. The image data of the transmission originals thus scanned by scanner unit 40 is processed as 8 bit image data and subjected to the predetermined image processes in multi-valued image processor 402 in main image processing board 400. The image processed data is then transferred to auxiliary image processing board 500, where the data is subjected to the binarizing process containing error diffusion process and the like, in binary image processor 501, and then compressed in the predetermined format and stored into memory 502. Subsequently, when the receiver's facsimile number is dialed up through the public phone network and once the transmission status is established, the image data is read out from memory 502, and is subjected to necessary processes such as compression-format conversion and the like in facsimile board 603. The thus processed data is then transmitted to the reception-side facsimile machine.

In order to receive the image data transmitted through the public phone network, the image data received by facsimile board 603 is transferred to binary image processor 501 via the facsimile interface, where the data is expanded so as to reproduce page-wise images. The image data of the thus pagewise reproduced image is transferred to main image processing board 400, where the data is subjected to image processes such as gamma correction etc. The thus processed data is then supplied to laser writing unit 46 via laser controller 404.

As has been stated, in copier 30, the image processing portion is configured by two parts, i.e., main image processing board 400 for processing multi-valued image data and auxiliary image processing board 500 for processing binary image data. The images of originals scanned by scanner portion 31 are image processed as multi-valued image data in main image processing board 400 and the data is supplied to laser writing unit 46, thus making it possible to reproduce copies of images on recording paper without losing the features of the original images. On the other hand, when a large number of copies need to be reproduced from many originals, the image data is processed as binary image data in auxiliary image processing board 500, thereby achieving high-speed processing.

Also, the apportionment of the image processor contributes to provide the copier with a variety of functions. Further, Since CPU 401 provided on main image processing board 400 controls each part of auxiliary image processing board 500, it is possible to ensure smooth flow of image data and processings without any loss of the image data when the image data is processed continuously by main image processing board 400 and auxiliary image process board 500.

Figure 3:
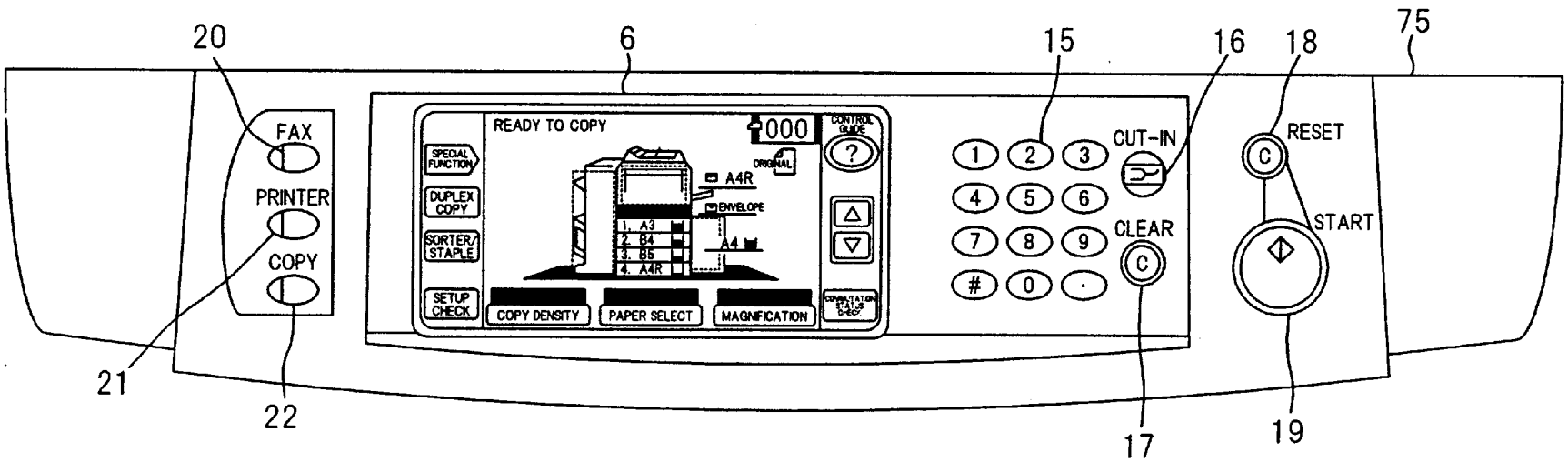
FIG. 3 is a plan view showing a control panel provided for the copier.

FIG. 3 is a plan view showing a control panel provided for the copier. Control panel 75 has display device 6 in the center thereof. Arranged on the right side of display device 6 in control panel 75 are tenkey 15 for inputting numeral information such as the copy number etc., a cut-in key 16 for permitting a different copy mode to be cut into the currently processing copy mode, a clear key 17 for clearing the conditions set up through tenkey 15 etc., a reset key 18 for canceling and reverting the setting state of digital copier 30 to the standard state and a start key 19 for starting the copying operation. Arranged further on the left side of display device 6 on control panel 75 are mode selecting keys 20 to 22 for selecting the operation mode of copier 30, from the facsimile mode, printer mode and copy mode.

The arrangement of the display device and keys on control panel 75 presented here is just an example, and keys arranged corresponding to the functions of copier 30 and the display contents on the display device 6 can be different.

Figure 4:
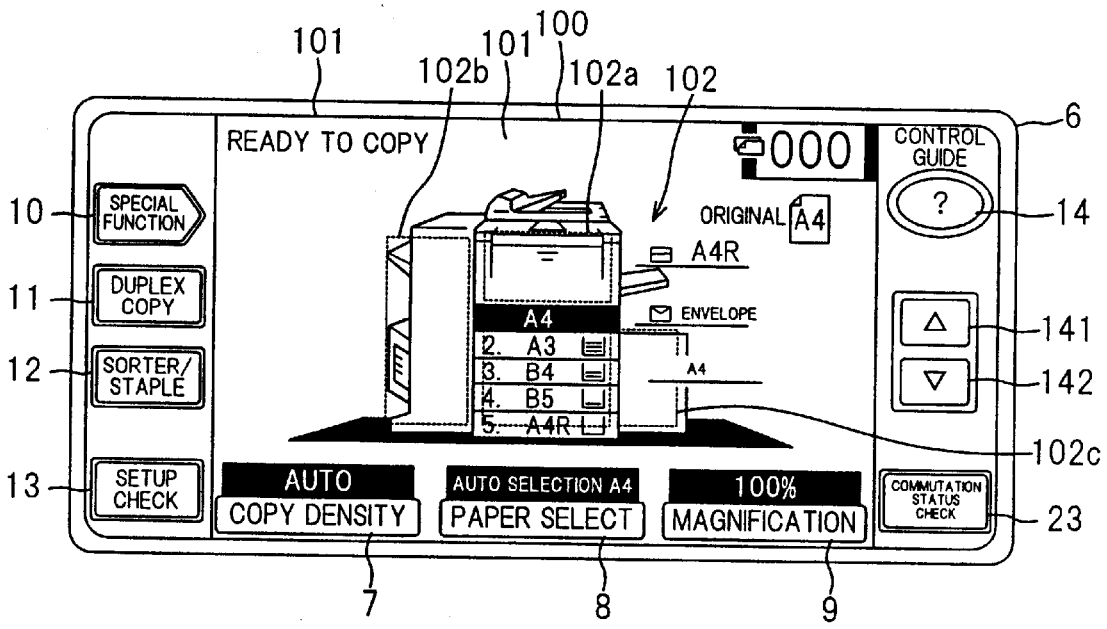
FIG. 4 is a view showing the detail of a display device arranged in the control panel of the copier.

FIG. 4 is a detailed view of the display device arranged in the control panel of the copier. Display device 6 of copier 30 has a liquid crystal display 100 in the center thereof. Arranged on the panel surface on the left and right sides in proximity to liquid crystal display 100 are: a special function mode key 10 for switching the display content of display device 6 into an editing mode setting frame for setting up an image editing function; a duplex copy mode key 11 for switching the frame into a duplex copy mode setting frame for setting up the duplex copy mode; a sorter/staple key 12 for switching the frame into a post-processing setting frame for setting up post-processing functions such as sorting and stapling and the like; a setting condition confirmation key 13 for confirming the contents of the currently set mode; a control guide key 14 for displaying the guidance of control methods and the like; scroll keys 141 and 142 for scrolling the display content of the guidance; and a communication status check key 23 for checking the communication state with external apparatuses.

In display device 6, a touch panel 101 is laminated over liquid crystal display 100 and over the keys inscribed on the panel surface, such as special function mode keys 10 etc. This touch panel 101 will detect the operated state of the keys displayed on display device 6 and the keys inscribed on the panel surface.

In the standard waiting state for the instruction of copy operation start through start key 19, copier 30 displays a basic frame shown in FIG. 4 in liquid crystal display 100 of display device 6. In this basic frame, an outline FIG. 102 schematically representing copier 30 is displayed in the centerthereof. This outline FIG. 102 includes a mainbody outline 102*a* of copier 30, a sorter outline 102*b* and feeder outline 102*c*, and main body outline 102*a* and feeder outline 102*c* are displayed with the sizes of recording paper etc. accommodated therein. Arranged below the outline figure of copier 30 are a copy density setting key 7 for designating the copy density, a paper size setting key 8 for selecting the paper size and a magnification ratio setting key 9 for designating the copy magnification ratio. This paper size setting key 8 corresponds to the control means of the invention.

Figure 5A:
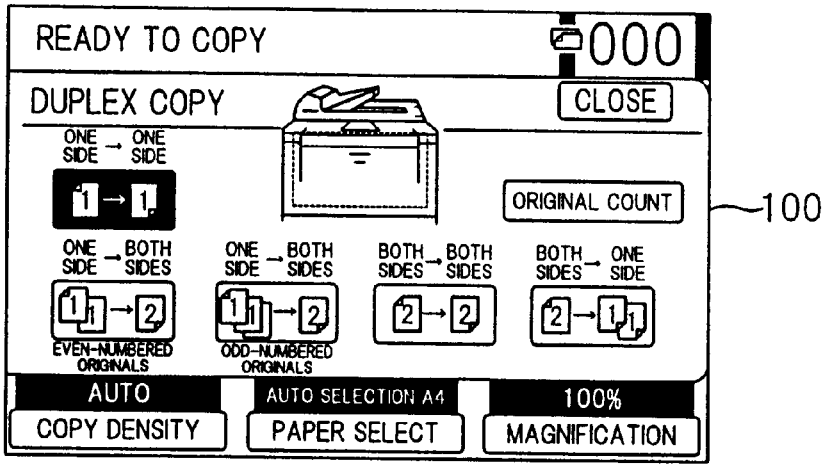
FIGS. 5A to 5C are views showing the setting frames to be displayed in the display device when keys in the basic frame were operated.
Figure 5B:
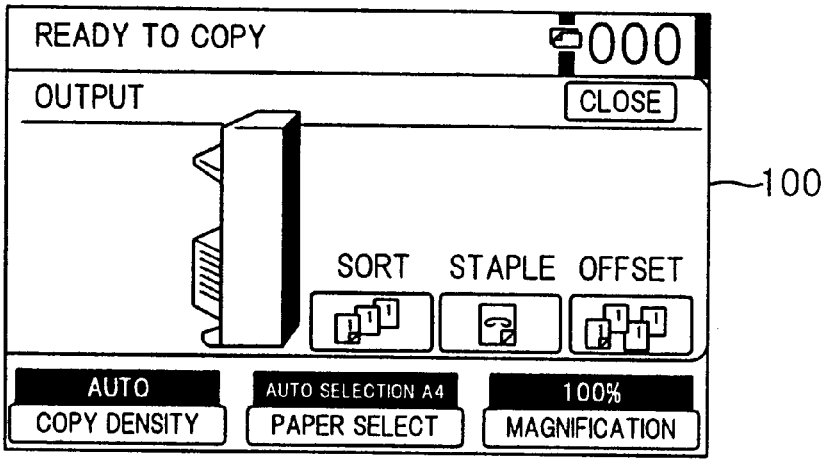
Figure 5C:
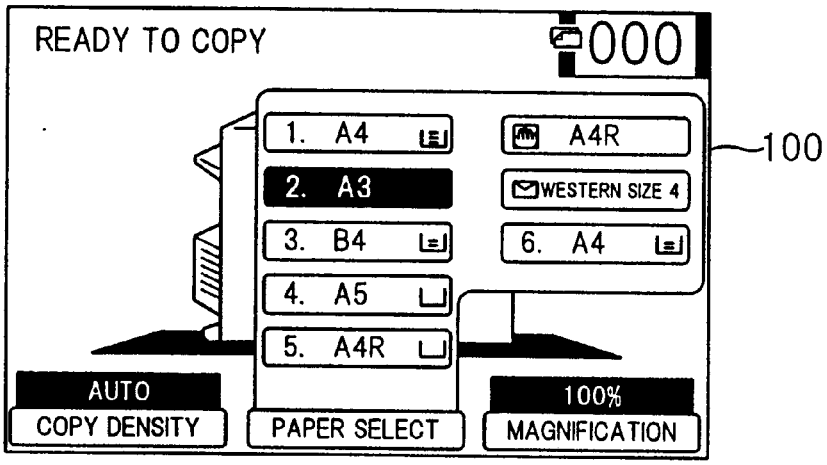

FIGS. 5A to 5C are views showing the setting frames to be displayed in the display device when keys in the basic frame were operated. When duplex copy mode key 11 is pressed in the state where the basic frame shown in FIG. 4 is displayed on liquid crystal display 100 of display device 6, the display frame of liquid crystal display 100 switches into the duplex copy mode setting frame shown in FIG. 5A. When sorter/staple key 12 is pressed in the state where the basic frame shown in FIG. 4 is displayed on liquid crystal display 100 of display device 6, the display frame of liquid crystal display 100 switches into the post-processing setting frame shown in FIG. 5B. When paper size setting key 8 is pressed in the state where the basic frame shown in FIG. 4 is displayed on liquid crystal display 100 of display device 6, the display frame of liquid crystal display 100 switches into the paper size setting frame shown in FIG. 5C.

Figure 6A:
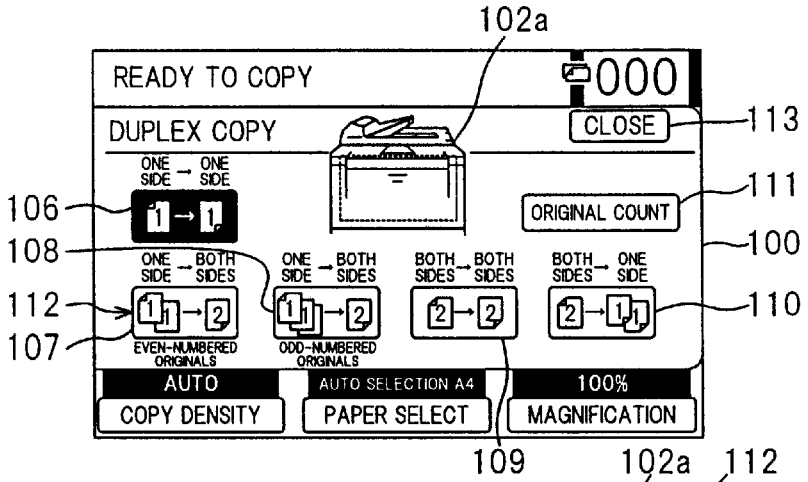
FIGS. 6A to 6C are views showing the duplex copy mode setting frames displayed in the display device of the copier.
Figure 6B:
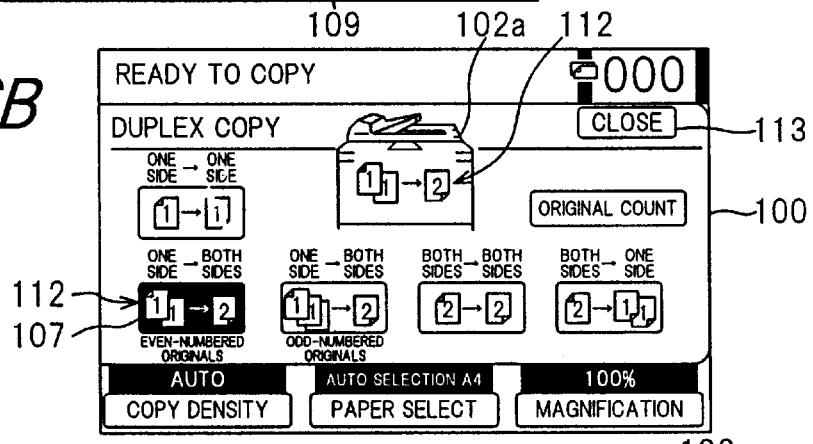
Figure 6C:
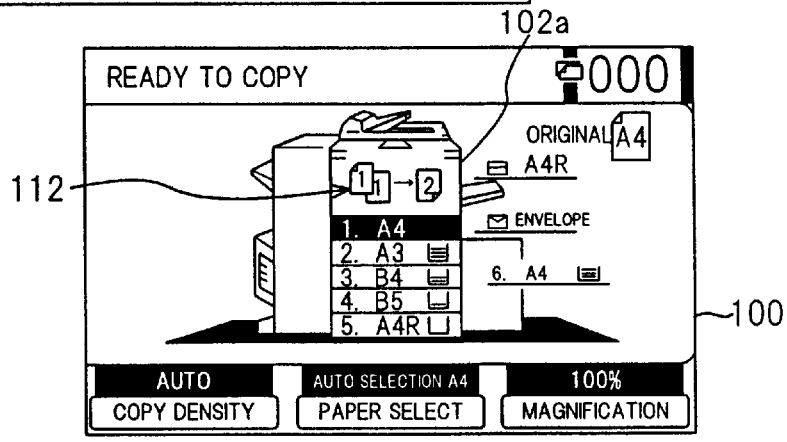

FIGS. 6A to 6C are views showing the duplex copy mode setting frames displayed in the display device of the copier. When the display position of main body outline 102*a* in outline FIG. 102 in the display frame shown in FIG. 4, or the inscribed position of duplex copy key 11 is pressed, the display frame of display device 6 switches into the duplex copy mode setting frame shown in FIG. 6A. In this duplex copy mode setting frame, setting keys for designating the processing conditions in the duplex copy mode are displayed in display device 6 together with main body outline 102*a* of outline FIG. 102 displayed in the basic frame of FIG. 4.

Illustratively, in the duplex copy mode setting frame, the key arranged on the left side of main body outline 102*a* is a key 106 for designating the standard state mode in which a one-sided original is duplicated to produce a one-sided copy. Arranged below main body outline 102*a* are: from the left, a key 107 for setting the mode in which an even number of one-sided originals are duplicated to produce two-sided copies; a key 108 for setting the mode in which an odd number of one-side originals are duplicated to produce two-sided copies; a key 109 for setting the mode in which two-sided originals are duplicated into two-sided copies; and a key 110 for setting the mode in which two-sided originals are duplicated to produce one-sided copies. Each key has an icon indicating the condition designated thereby. Displayed also on the right side of main body outline 102*a* are: a key 111 for performing counting of originals when it is unknown whether the originals of one-side originals to be processed are in even number or in odd number; and a key 113 to be operated when the setting operation in the duplex copy mode setting image needs to be ended.

In the above description, the displayed positions of main body outline 102*a* and keys 106 to 113 in liquid crystal display 100 are not limited to those shown in FIG. 6A. That is, in the duplex copy mode setting frame shown in FIG. 6A, main body outline 102*a* is displayed in its original position shown in the basic frame shown in FIG. 4. However, the display positions of keys 106 to 113 may be determined first in the duplex copy mode setting frame and then main body outline 102*a* may be displayed in a different position from that shown in the basic frame. Nevertheless, it is preferred that main body outline 102*a* should be displayed at the same position and in the same size in order to avoid the operator's confusion.

In the duplex copy mode setting frame shown in FIG. 6A, when one of keys 106 to 110 is pressed, the icon indicating the designated process condition is displayed within main body outline 102*a* in the display frame. For example, in the display frame shown in FIG. 6A, when key 107 for setting up the mode in which an even number of one-sided originals are duplicated to produce two-sided copies is pressed, an icon 112 which is identical with that displayed in key 107 is displayed within main body outline 102*a*, as shown in FIG. 6B. When key 113 is pressed from this state, designation of the mode in which even one-sided originals are copied to produce two-sided copies is determined, and the display frame of liquid crystal display 100 switches into the basic frame with icon 112 displayed in main body outline 102*a*.

In this way, the icon inscribed on the key which has been pressed during the display of the duplex copy mode setting frame continues to be displayed in main body outline 102*a* after the switch of the display frame, thus making it possible for the operator to easily confirm the processing conditions which they have set up by themselves.

In connection with this, when an operator operates key 106 to set up the mode where a one-sided original is copied to produce a one-sided copy, no duplex copy mode is set up, so the icon inscribed on key 106 does not need to be displayed in main body outline 102*a*.

Further, while the liquid crystal display 100 is displaying the duplex copy mode setting frame, if processing conditions can be input and set up through the keys in control panel 75, other than keys 106 to 111 and 113 displayed in liquid crystal display 100, the icon inscribed in the operated key may also be displayed in main body outline 102*a*.

FIGS. 7A to 7C and FIG. 8 are views showing the post-processing setting frames displayed in the display device of the copier. When the display position of sorter outline 102*b* in outline FIG. 102 in the basic frame shown in FIG. 4, or the inscribed position of sorter/stable key 12 is pressed, the display frame of liquid crystal display 100 switches into the post-processing mode setting frame shown in FIG. 7A. In this post-processing mode setting frame, setting keys for designating the processing conditions in the post-processing mode are displayed together with sorter outline 102*b* that was displayed in the basic frame.

Illustratively, displayed on the right side of sorter outline 102*b* in liquid crystal display 100 are keys with icons representing the contents of their function, which include: a key 114 for selecting the sorting function to separates the copied sheets into multiple collated groups; a key 115 for selecting the stapling function to staple copied sheets; and a key 116 for selecting the offset function to place groups of copied sheets offset from each other. Further a key 113 for closing the display of the output function in the display frame is displayed in the upper right portion of sorter outline 102*b*.

Figure 7A:
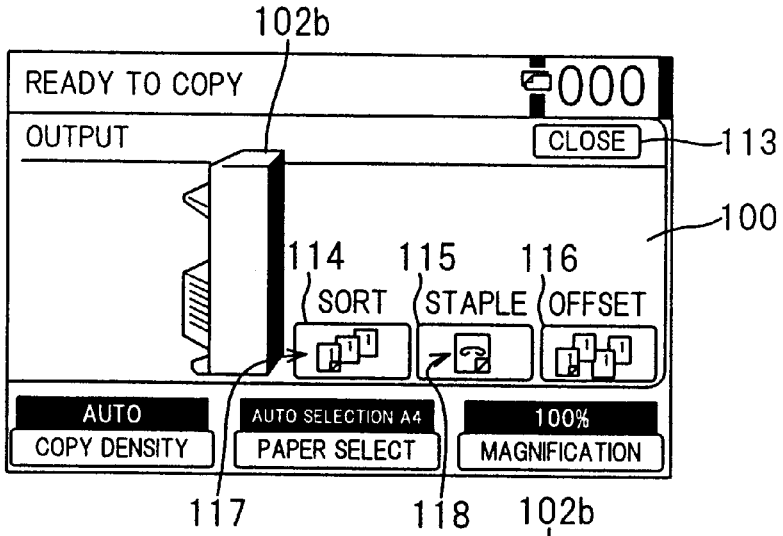
FIGS. 7A to 7C are views showing the post-processing setting frames displayed in the display device of the copier.

The displayed positions of sorter outline 102*b* and keys 113 to 116 in liquid crystal display 100 should not be limited to that shown in FIG. 7A. In the post-processing setting frame shown in FIG. 7A, sorter outline 102*b* is displayed at the same position as in the basic frame shown in FIG. 4. However, the displayed positions of keys 113 to 116 may be determined first and then sorter outline 102*b* may be laid out at a different position from that in the basic frame. Nevertheless, it is preferred that sorter outline 102*b* should be displayed at the same position and in the same size as in the post-processing setting frame in order to avoid the operator's confusion.

Figure 7B:
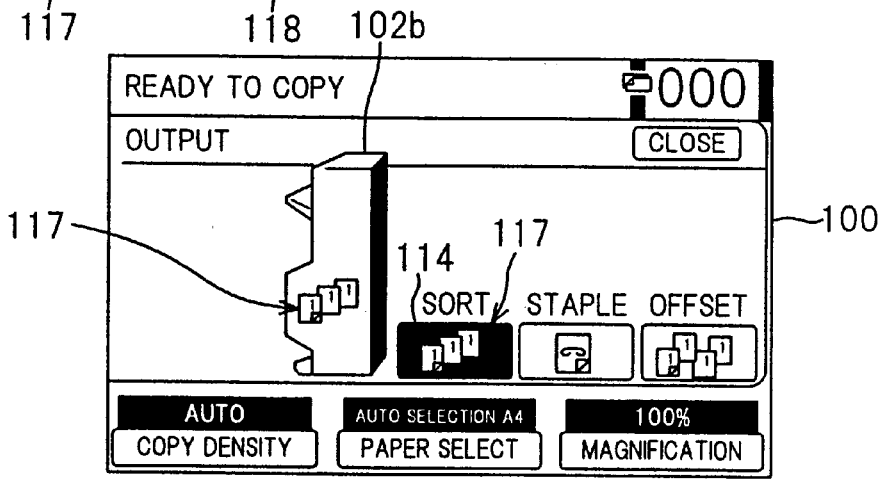

In the display frame shown in FIG. 7A, when one of keys 114 to 116 is pressed, the icon indicating the designated process condition is displayed within sorter outline 102*b* in the display frame. For example, in the display frame shown in FIG. 7A, when key 114 for setting up the sorting function is pressed, an icon 117 which is identical with that displayed in key 114 is displayed within sorter outline 102*b*, as shown in FIG. 7B. When two or more keys, among keys 114 to 116 in the display frame shown in FIG. 7A, which are compatible in their setup are operated, an icon indicating the designated, process functions in an overlapped manner may be displayed within sorter outline 102*b* in the display frame.

Figure 7C:
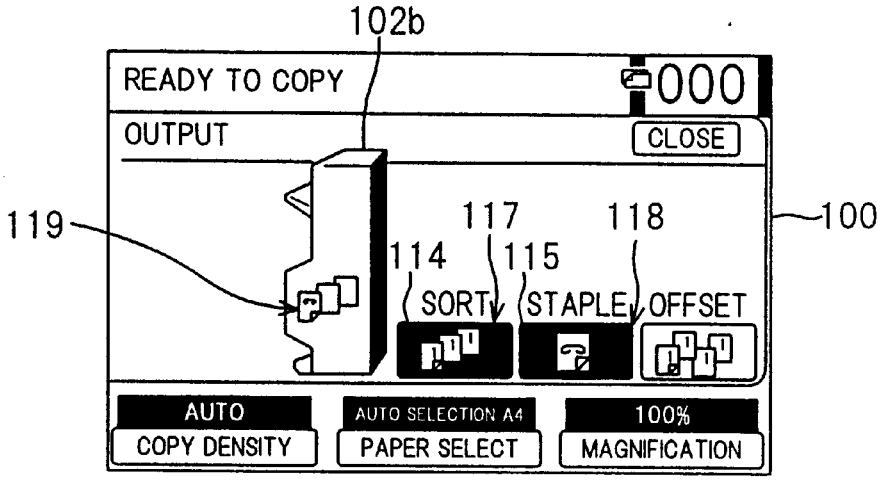
Figure 8:
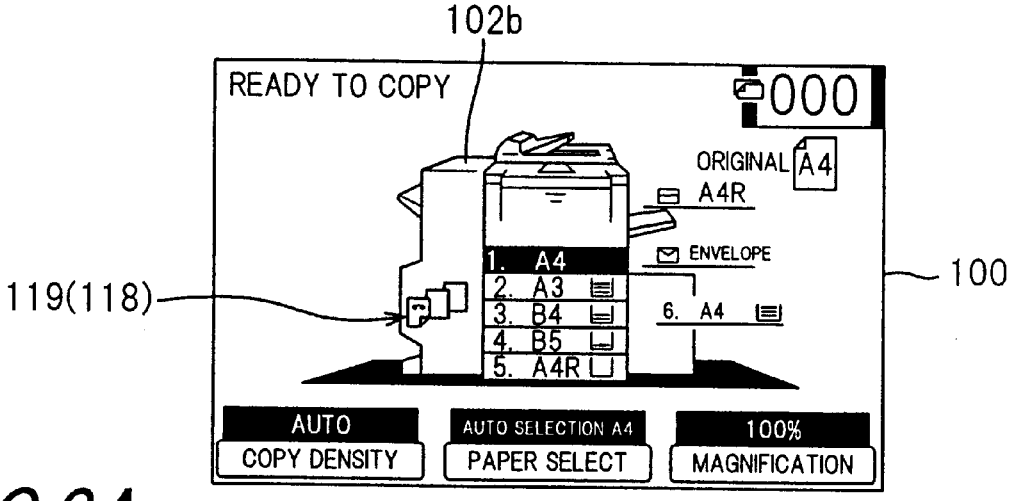
FIG. 8 is a view showing one of the post-processing setting frames displayed in the display device of the copier.

For example, when the sorting function and the stapling function are set up simultaneously, an icon 119 which represents the combination of icons 117 and 118 of keys 114 and 115 is displayed in sorter outline 102*b*, as shown in FIG. 7C. When key 113 is pressed from the state shown in FIG. 7B or 7C, the sorting function or the sorting and stapling functions are confirmed, so the display frame of liquid crystal display 100 switches into the basic frame with icon 118 or 119 displayed in sorter outline 102*b* as shown in FIG. 8.

In this way, the icon inscribed on the key or keys which have been pressed during displaying the post-process setting frame continues to be displayed in sorter outline 102*b* after the switch of the display frame, thus making it possible for the operator to easily confirm the processing conditions which they have set up by themselves.

In connection with this, when an operator operates a key of the process conditions set up previously in the standard mode, for example, in the case where the sorting process has been previously set up such that multiple originals need to be copied to produce multiple sets of the copies, there will be no need to display the icon inscribed in key 114 if the operator presses key 114 in order to set up the sorting process.

Further, while the liquid crystal display 100 is displaying the post-process setting frame, if processing conditions can be set up through the keys in control panel 75, other than keys 113 to 116 displayed in liquid crystal display 100, the icon inscribed in the operated key may be displayed in sorter outline 102*b*.

Figure 9A:
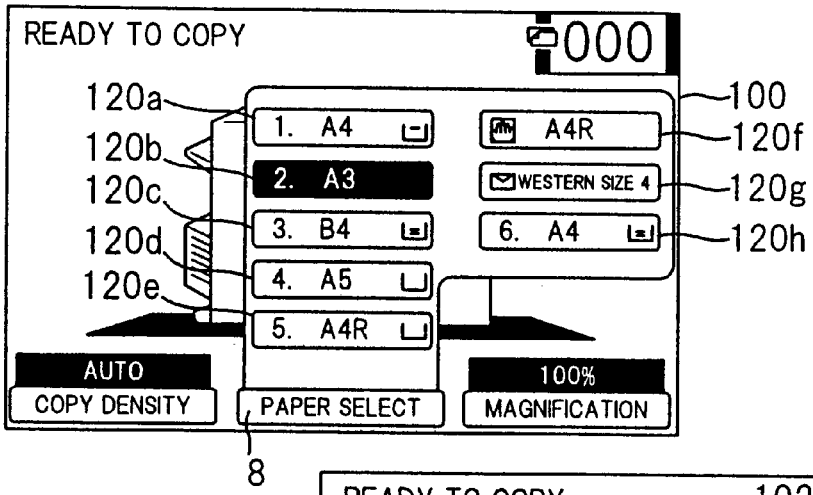
FIGS. 9A to 9B are views showing the paper size setting frames displayed in the display device of the copier.
Figure 9B:
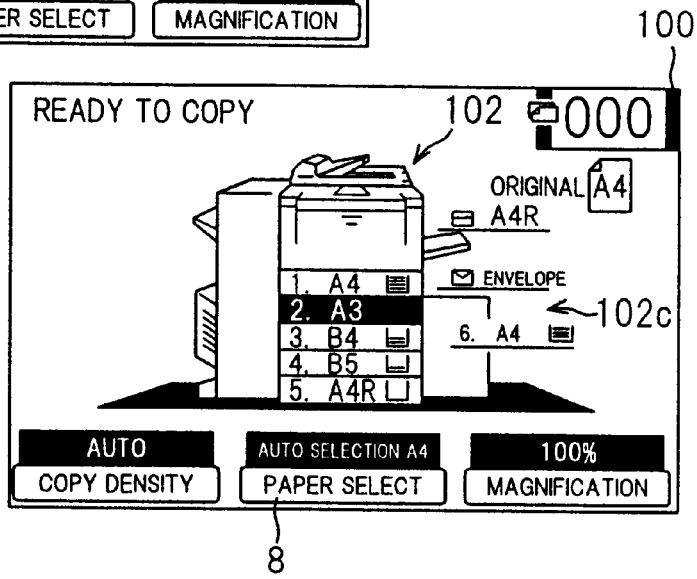

FIGS. 9A and 9B are views showing the paper size setting frames displayed in the display device of the copier. When the display position of feeder outline 102*c* in outline FIG. 102 in the basic frame shown in FIG. 4, or the displayed position of paper size setting key 8 is pressed, the display frame of liquid crystal display 100 switches into the paper size setting frame shown in FIG. 9A. In this paper size setting frame, the representation for automatic size selection in the basic frame shown in FIG. 4 is removed while paper feeder positions 120*a* to 120*h* which correspond to actual positions in the paper feeding portion of copier 30 are displayed in the upper and upper right area of paper size setting key 8. For this display, paper feeder positions 120*a* to 120*h* are displayed being laid over outline FIG. 102 in the basic frame.

Figure 10:
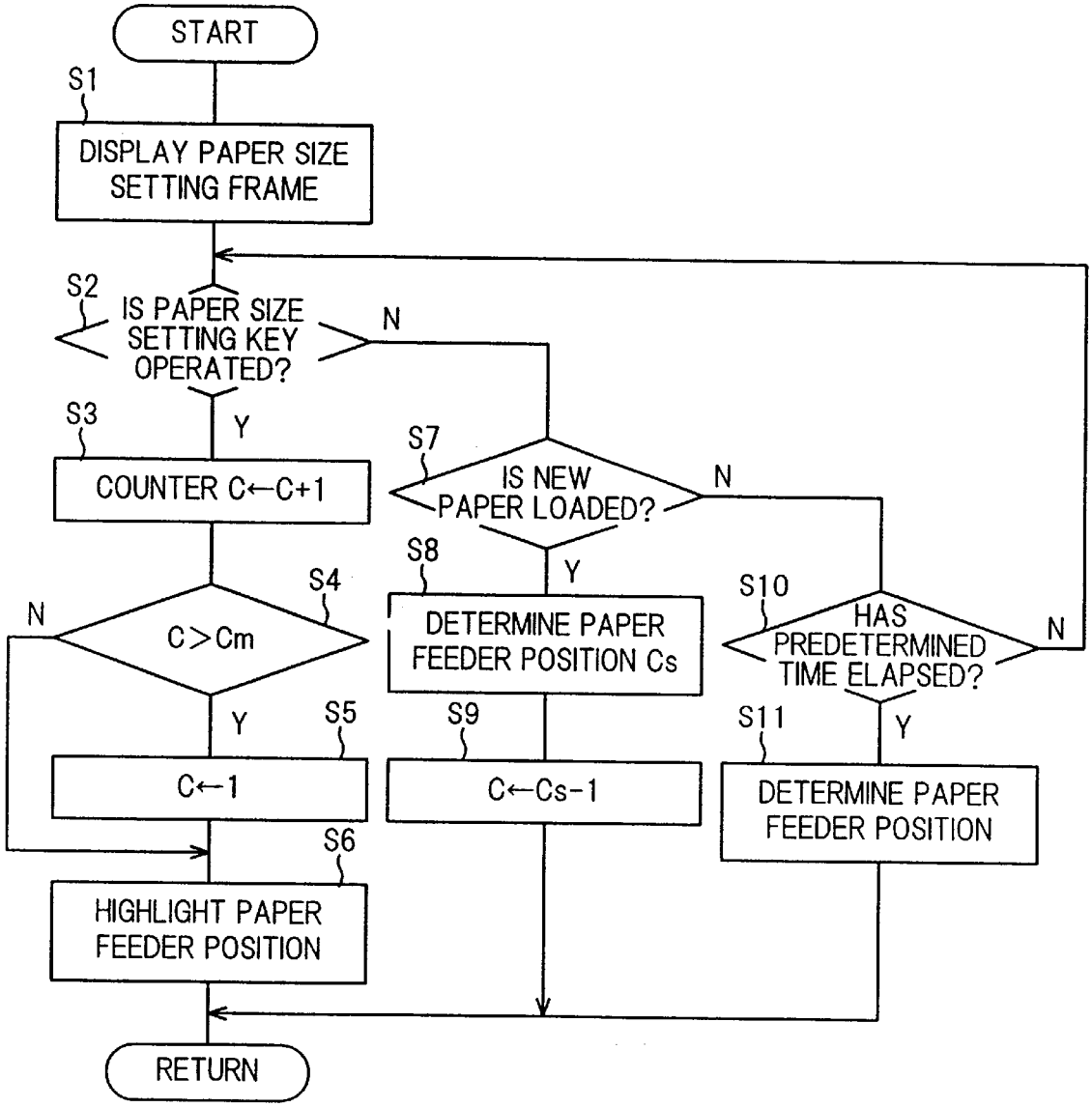
FIG. 10 is a flowchart showing the procedural steps of the controller of the copier in the paper size setting mode.

FIG. 10 is a flowchart showing the procedural steps of the controller of the copier in the sheet setting mode. While liquid crystal display 100 is showing the basic frame shown in FIG. 4, the displayed position of feeder outline 102*c* of outline FIG. 102, or the displayed position of paper size setting key 8 is pressed, CPU 701 on operation panel board 700 starts the operation in paper size setting mode so that liquid crystal display 100 displays the paper size setting frame shown in FIG. 9A(s1) and waits for the operation of paper size setting key 8(s2).

When paper size setting key 8 is pressed, CPU 701 increases the count value in counter C by one(s3). The count value in this counter C is stored in the predetermined memory area in memory 702. The count value of counter C is the value for specifying one of feeder positions 120*a* to 120*h* in the paper size setting frame, taking a value of '1' to '8' corresponding to feeder positions 120*a* to 120*h*, respectively.

CPU 701 judges whether the count value in counter C after increment is greater than the maximum value Cm (Cm=8 in this example) (S4). If the count value of counter C is greater than the maximum value Cm, the count value in counter C is set at '1'(s5). Then CPU 701 highlights the feeder position corresponding to the count value of counter C, among the feeder positions 120*a* to 120*h* in the paper size setting frame(s6).

If any of the sensors arranged in the paper feeder positions in copier 30 detects a new loading of paper while CPU 701 is waiting for the operation of paper size setting key 8, CPU 701 determines count value Cs corresponding to the feeder position to which new paper has been loaded(s7→s8) and sets the counter at a count value of Cs−1(s9). When the predetermined time has elapsed before the operation of paper size setting key 8 or before new paper is loaded, CPU 701 determines that the feeder position corresponding to the count value of counter C should be the position from which paper is fed, and ends the procedures of the paper size setting mode while displaying the basic frame with the determined feeder position highlighted on liquid crystal display 100 as shown in FIG. 9B(s2→s7→s10→s11).

By the above procedural steps, when the operator has selected the paper size setting mode and has loaded new paper to any of the feeder positions in the paper feeding portion in copier 30, the feeder position to which new paper has been loaded is selected at the operator's first operation of paper size setting key 8 after the paper loading. Usually, when the operator has loaded new paper, there is a good chance that the newly loaded paper will be used for copying operation. On the contrary, in some cases another operator, who is different from the operator intending to perform the copying task, may load paper for their own needs, into the paper feeding portion, in other cases, an operator who notices a lack of paper of a size different from their own desired size, may load paper of that size. Therefore, newly loaded paper is not always used to perform the copying operation. This is why the apparatus waits for the operator's confirmation by the operation of paper size setting key 8 and thereafter the newly loaded paper is selected. Thus, it is possible to select a needed paper size efficiently and correctly in accordance with the operator's intention.

Figure 11:
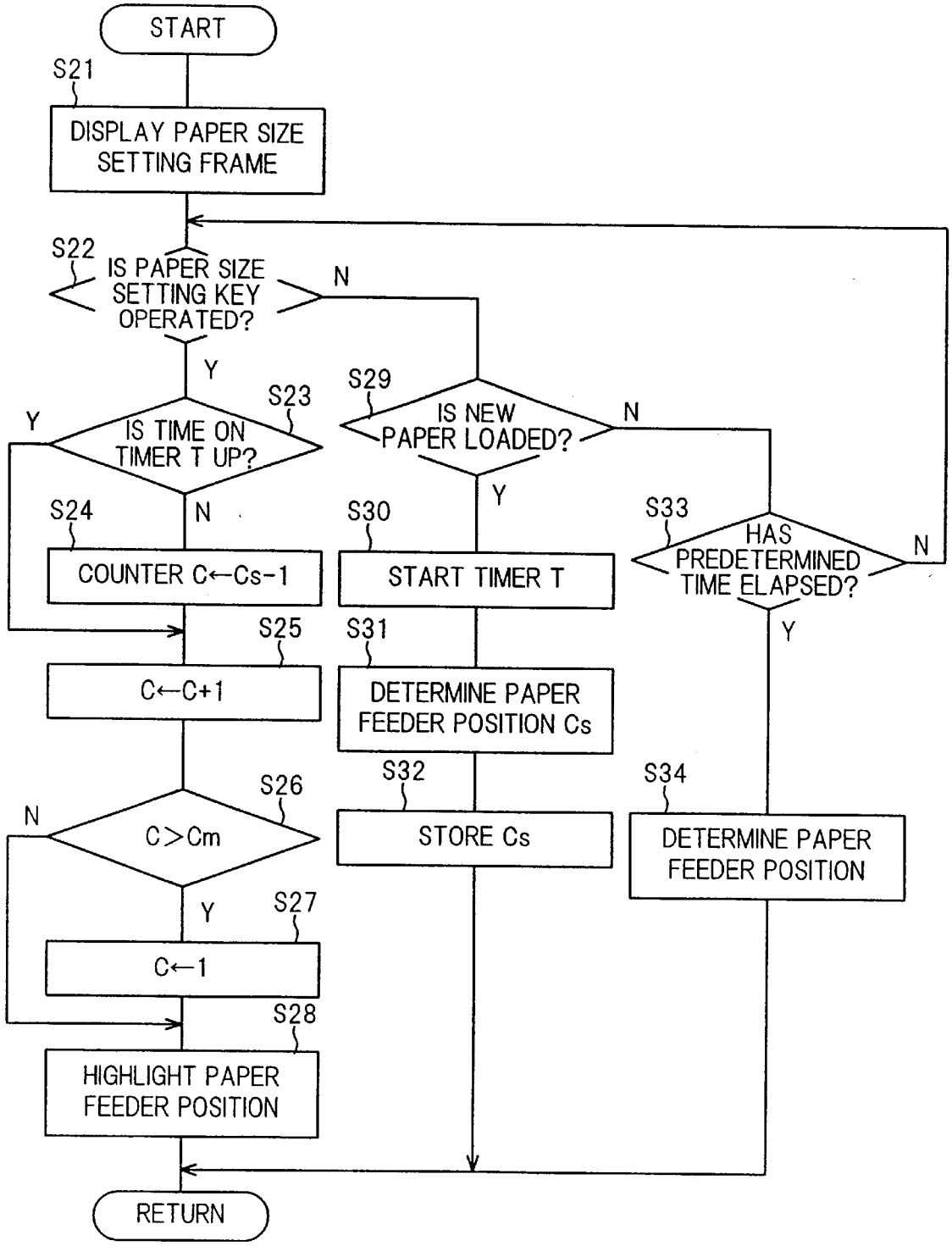
FIG. 11 is a flowchart showing the procedural steps of the controller of a copier in the paper size setting mode in accordance with another embodiment of the invention; and, FIGS. 12A and 12B are flowcharts showing the procedural steps of the controller of a copier in the sheet setting mode in accordance with still another embodiment of the invention.

FIG. 11 is a flowchart showing the procedural steps of the controller in the sheet setting mode of a copier in accordance with another embodiment of the invention. While liquid crystal display 100 is showing the basic frame shown in FIG. 4, the displayed position of feeder outline 102*c*, or the displayed position of paper size setting key 8 is pressed, CPU 701 on operation panel board 700 starts the operation in paper size setting mode so that liquid crystal display 100 displays the papersize setting frame shown in FIG. 9A(s21) and waits for the operation of paper size setting key 8(s22).

When paper size setting key 8 is pressed, CPU 701 judges whether the time measured by a timer T is up(s23). The set time of this timer T is stored in the predetermined memory area in memory 702 and the timer measures a fixed time previously determined. Then CPU 701 sets a counter C at a count value of Cs−1 when time on timer T is not up(s24). If time on timer T is up, operation goes directly to the step(s25) where the count value of counter C is increased by one. This counter C is the same as in the procedures shown in FIG. 10. Count value Cs is stored in the predetermined memory area of memory 702 in the aftermentioned process.

CPU 701 judges whether the count value in counter C after increment is greater than the maximum value Cm (Cm=8 in this example)(S26). If the count value of counter C is greater than the maximum value Cm, the count value in counter C is set at '1' (s27). Then CPU 701 highlights the feeder position corresponding to the count value of counter C, among the feeder positions 120*a* to 120*h* in the paper size setting frame(s28).

If any of the sensors arranged in the paper feeder positions in copier 30 detects a new loading of paper while CPU 701 is waiting for the operation of paper size setting key 8, CPU 701 starts timer T(s29 and s30), then determines count value Cs corresponding to the feeder position to which new paper has been loaded(s31) and stores the determined result into the predetermined memory area of memory 702(s32). When the predetermined time has elapsed before an operation of paper size setting key 8 or before new paper is loaded, CPU 701 determines that the feeder position corresponding to the count value of counter C should be the position from which paper is fed, and ends the procedures of the paper size setting mode while displaying the basic frame with the determined feeder position highlighted on liquid crystal display 100, as shown in FIG. 9B(s33 and s34).

By the above procedural steps, when the operator has selected the paper size setting mode and has loaded new paper to any of the feeder positions in the paper feeding portion in copier 30, the feeder position to which new paper has been loaded is selected first if the operator operates the paper size setting key 8 before the predetermined time lapses after the loading of new paper. In this way, while the paper size setting mode is active, the selecting order of the feeder positions by the operation of paper size setting key 8 is changed depending upon whether the predetermined time has elapsed before the operator's first operation of paper size setting key 8 after the loading of new paper. Thus, it is possible to select a needed paper size more efficiently and correctly.

Figure 12A:
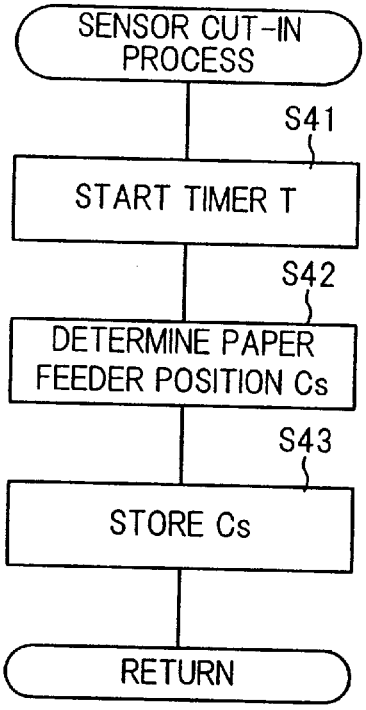
Figure 12B:
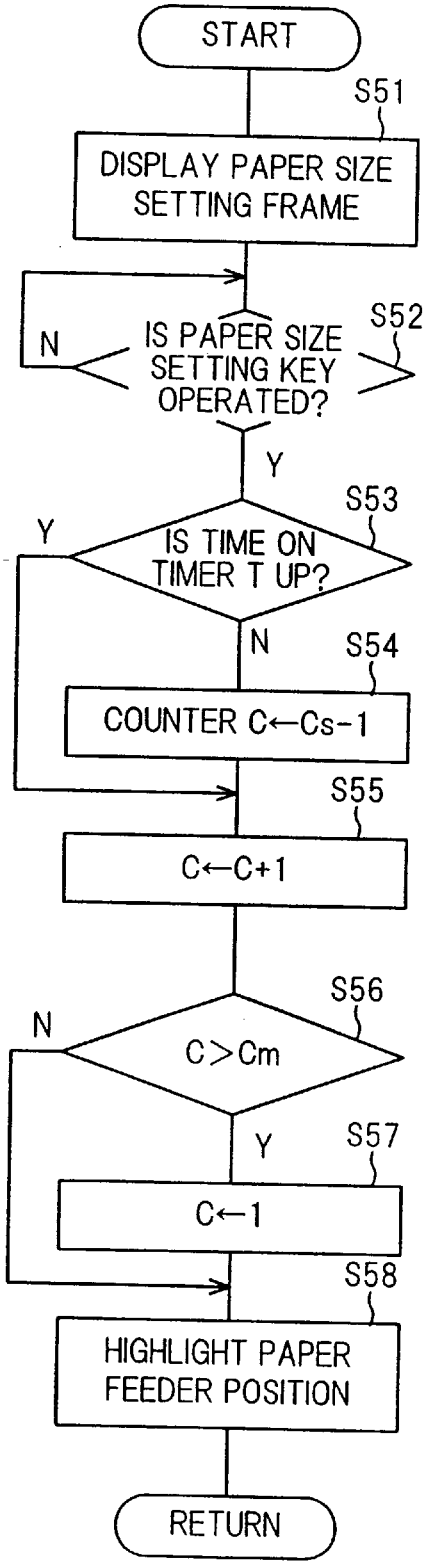

FIGS. 12A and 12B are partial flowcharts showing the procedural steps of the controller of a copier in accordance with a further embodiment of the invention. In the copier of this embodiment, regardless of the set mode, when loading of new paper in the paper feeding portion is detected by the sensors, the sensor cut-in process shown in FIG. 12A is executed. In this sensor cut-in process, CPU701 starts a timer T that is stored in the predetermined memory area in memory 702(s41), then determines count value Cs in a counter C corresponding to the feeder position to which new paper is loaded(s42). The determined result is stored in the predetermined memory area in memory 702(s43). Timer T and counter C have the same functions as those used in the process shown in FIG. 11.

While liquid crystal display 100 is showing the basic frame shown in FIG. 4, when the operator presses the displayed position of feeder outline 102*c*, or the displayed position of paper size setting key 8, CPU 701 on operation panel board 700 starts the operation in paper size setting mode shown in FIG. 12B so that liquid crystal display 100 displays the paper size setting frame shown in FIG. 9A(s51) and waits for the operation of paper size setting key 8(s52).

When paper size setting key 8 is pressed, CPU 701 judges whether time measured by a timer T is up(s53). The time on this timer is stored in the predetermined memory area in memory 702 and the timer measures a fixed time previously determined. CPU 701 sets counter C at a count value of Cs−1 when time on timer T is not up(s54). If time on timer T is up, operation goes directly to the step(s55) where the count value of counter C is increased by one.

CPU 701 judges whether the count value in counter C after increment is greater than the maximum value Cm (Cm=8 in this example)(S56). If the count value of counter C is greater than the maximum value Cm, the count value in counter C is set at '1' (s57). Then CPU 701 highlights the feeder position corresponding to the count value of counter C, among the feeder positions 120*a* to 120*h* in the paper size setting frame(s58).

By the above procedural steps, when the operator has loaded new paper to any one of the feeder positions in the paper feeding portion of copier 30, the feeder position to which the new paper has been loaded is selected first if the operator operates the paper size setting key 8 before the predetermined time lapses after the loading of new paper. Thereby, the paper size setting mode is activated when new paper has been loaded. Further, the selecting order of the feeder positions by the operation of paper size setting key 8 is changed depending upon whether the predetermined time has elapsed before the operator's first operation of paper size setting key 8 after loading of new paper. Thus, regardless of the mode being set when new paper was loaded, it is possible to perform efficient and correct selection of paper size.

In all the copiers of the above embodiments, the selected, feeder position is switched sequentially from one to another in one direction every time paper size setting key 8 is pressed.

However, in a configuration in which two keys, count-up and count-down keys are provided for paper size setting key 8, the selected, feeder position can be switched sequentially from one to another in a selected direction every time the count-up or count-down key is pressed. In this case, the apparatus should be configured so that, when the count-up or count-down key is operated at the first time after new paper was loaded, the newly set paper is selected as the paper to be fed.

Up to now, the embodiment of the invention has been described referring to examples of copiers, but the present invention can be also applied similarly to other sheet processing apparatuses in which a multiple types of paper are set in the paper feeding portion and one type of paper is selectively fed and processed. It should be understood that the multiple types of paper accommodated in the multiple feeder positions in the paper feeding portion may be not only different in size but also different in material and thickness.

In accordance with the first feature of the invention, since the paper to be fed can be selected in a predetermined sequential order from the paper newly loaded, paper to be fed to the processing portion can be selected quickly during the paper selecting task after the paper to be fed was loaded to the paper feeding portion. Further, during the paper selecting task after paper which is different from that to be fed has been loaded to the paper feeding portion, paper to be fed to the processing portion can be selected in a predetermined sequential order. Thus, it is possible to select a needed paper size efficiently and correctly in accordance with the operator's intention. As a result, the paper selecting task can be simplified and shortened in time to improve the operating efficiency of the apparatus. It is also possible to positively prevent waste of paper due to a paper feeding which the operator does not intend.

In accordance with the second feature of the invention, during the period of from the time at which new paper was loaded until the predetermined time elapses, paper to be fed is selected in a predetermined sequential order from the paper newly loaded. Therefore, paper to be fed to the processing portion can be selected quickly during the paper selecting task after the paper to be fed was loaded to the paper feeding portion until the predetermined time elapses. Further, during the paper selecting task after the predetermined time has elapsed from loading of paper to the paper feeding portion or after paper which is different from that to be fed has been loaded to the paper feeding portion, paper to be fed to the processing portion can be selected in a predetermined sequential order. Thus, it is possible to select a needed paper size more efficiently and correctly in accordance with the operator's intention. As a result, the paper selecting task can be simplified and shortened in time to further improve the operating efficiency of the apparatus. It is also possible to surely prevent waste of paper due to a paper feeding which the operator does not intend.

In accordance with the third and fourth features of the invention, every time the control means is operated, paper to be fed is sequentially switched from one to another in the predetermined direction from that to which new paper was loaded. Therefore this configuration permits quick selection of paper, enabling the first operation of the control means to select the paper newly loaded to the paper feeding portion as the paper to be fed to the processing portion, during the paper selecting task after the paper to be fed was loaded to the paper feeding portion. Further, during the paper selecting task after paper which is different from that to be fed has been loaded to the paper feeding portion, paper to be fed to the processing portion can be selected by operating the control means the predetermined number of times. Thus, it is possible to select a needed paper size efficiently and correctly in accordance with the operator's intention. As a result, the paper selecting task can be simplified and shortened in time to improve the operating efficiency of the apparatus. It is also possible to surely prevent waste of paper due to a paper feeding which the operator does not intend.

In accordance with the fifth through eighth features of the invention, since paper to be fed to the image forming portion can be selected in a predetermined sequential order from the paper newly loaded, paper to be fed to the image forming portion can be selected quickly during the paper selecting task after the paper to be fed was loaded to the paper feeding portion. Further, during the paper selecting task after paper which is different from that to be fed has been loaded to the paper feeding portion, paper to be fed to the image forming portion can be selected in a predetermined sequential order. Thus, it is possible to select a needed paper size efficiently and correctly in accordance with the operator's intention. As a result, the paper selecting task can be simplified and shortened in time to improve the operating efficiency of the image forming apparatus. It is also possible to surely prevent waste of paper due to a paper feeding which the operator does not intend.

What is claimed is:

1. A sheet processing apparatus which selects and feeds one type of paper from plural types of paper accommodated in a paper feeding portion to a processing portion to execute a predetermined process for the paper, characterized in that paper to be fed to the processing portion is selected from the plural types of paper stored in the paper feeding portion by switching from one type of paper to another type of paper in a predetermined sequential order beginning initially, in response to a user provided paper type select input, with the type of paper which was loaded to the paper feeding portion last.

2. The sheet processing apparatus according to claim 1, further comprising a time measuring means for measuring the time which has elapsed from the last time when paper was loaded to the paper feeding portion, wherein during the period before time measured by the time measuring means reaches the predetermined time, paper to be fed to the processing portion is selected from the plural types of paper stored in the paper feeding portion by switching from one type of paper to another type of paper in a predetermined sequential order from the type of paper which was loaded to the paper feeding portion last.

3. The sheet processing apparatus according to claim 1, further comprising a control means that allows for designation of the paper to be fed from the paper feeding portion to the processing portion, wherein, every time the control means is operated, paper to be fed to the processing portion is selected from the plural types of paper by switching the feeder position from one paper type position to another paper type position in a predetermined sequential order from the paper type position to which paper was loaded last.

4. The sheet processing apparatus according to claim 2, further comprising a control means that allows for designation of the paper to be fed from the paper feeding portion to the processing portion, wherein, every time the control means is operated, paper to be fed to the processing portion is selected from the plural types of paper by switching the feeder position from one paper type position to another paper type position in a predetermined sequential order from the paper type position to which paper was loaded last.

5. The sheet processing apparatus according to claim 1, wherein the processing portion is an image forming processing portion for forming images on the paper fed from the paper feeding portion.

6. The sheet processing apparatus according to claim 2, wherein the processing portion is an image forming processing portion for forming images on the paper fed from the paper feeding portion.

7. The sheet processing apparatus according to claim 3, wherein the processing portion is an image forming processing portion for forming images on the paper fed from the paper feeding portion.

8. The sheet processing apparatus according to claim 4, wherein the processing portion is an image forming processing portion for forming images on the paper fed from the paper feeding portion.

* * * * *